United States Patent [19]

Onoda et al.

[11] Patent Number: 4,649,751

[45] Date of Patent: Mar. 17, 1987

[54] SUPERVISORY OPERATION CONTROL SYSTEM FOR PROTECTING ELEVATORS OR THE LIKE FROM A DANGEROUS SITUATION

[75] Inventors: Yoshimitsu Onoda, Toride; Takato Yamakoshi, Matsudo; Shigeru Arakawa, Nagareyama, all of Japan

[73] Assignees: Hitachi Elevator Engineering & Service Co., Ltd.; Hitachi Ltd., both of Tokyo, Japan

[21] Appl. No.: 710,236

[22] Filed: Mar. 11, 1985

[30] Foreign Application Priority Data

Mar. 16, 1984 [JP] Japan ..... 59-49259

[51] Int. Cl.[4] ..... B66B 13/24

[52] U.S. Cl. ..... 73/658; 187/107; 376/217

[58] Field of Search ..... 73/658; 187/29 R; 376/216, 217

[56] References Cited

U.S. PATENT DOCUMENTS

| | | | |
|---|---|---|---|
| 3,783,978 | 1/1974 | Hamilton | 187/29 R |
| 4,069,897 | 1/1978 | Tomate et al. | 187/29 R |
| 4,106,594 | 8/1978 | Kirsch et al. | 187/29 R |
| 4,238,005 | 12/1980 | Watanabe et al. | 187/29 R |
| 4,382,489 | 5/1983 | Suzuki et al. | 187/29 R |

OTHER PUBLICATIONS

"An Earthquake-Emergency Landing Device with a Primary-Wave Sensor for Elevators," Suzuski et al, *Mitsubishi Electric Advance,* vol. 15, Mar. 1981, pp. 10–11.

*Primary Examiner*—Howard A. Birmiel

*Attorney, Agent, or Firm*—Antonelli, Terry & Wands

[57] ABSTRACT

A supervisory operation control system responds to detection of vibration occurring at a predetermined location of an equipment for causing the equipment susceptible to adverse influence of the vibration to perform a predetermined supervisory operation. Transition to the supervisory operation is enabled when a product of speed and displacement of the vibration exceeds a predetermined value.

6 Claims, 9 Drawing Figures

SUPERVISORY OPERATION CONTROL SYSTEM FOR PROTECTING ELEVATORS OR THE LIKE FROM A DANGEROUS SITUATION

The present invention relates to a supervisory control system for elevators or lifts, various railway equipments, power plants inclusive of nuclear plants, plant equipments for chemical industries and the like. More particularly, the invention concerns a supervisory operation control system which can assure reliable supervisory operations conforming to actually prevailing situations upon occurrence of an earthquake or the like abnormal events.

In the elevator systems, various railways, power plant of large capacity or other various plant equipments, occurrence of an earthquake in the course of operation of these plants results in that the plant facilities are subjected to intensive shaking or vibration, involving occurrence of abnormalities in the facilities which may bring about dangerous situations.

Accordingly, it is desirable that upon appearance of vibration due to the earthquake or the like events in a predetermined place or location such as buildings in which various equipments or facilities are housed or the sites of the buildings or plants, control of the operations of the plants or equipments is put into effect as early as possible so that occurrence of abnormalities due to the vibration will not involve a dangerous situation in the operations of the plants or equipments. The operation of this sort may be referred to as the supervisory operation and the control for effecting the supervisory operation is referred to as the supervisory operation control.

By way of example, in the case of an elevator or lift system which is installed in a building, the elevator car or cage carrying passengers will stop at other positions than the predetermined landing place when an abnormality intervenes in the running function or performance of the elevator or lift car because of swinging or shaking of the building due to the earthquake or strong winds, as the result of which the passengers are confined within the car. Accordingly, the supervisory operation control capability is of great utility in order to prevent the dangerous situation and assure restoration of the elevator system to the normal operation as soon as possible when the shaking is mitigated or settled. Such being the circumstances, there exists an increasing tendency to adopt the supervisory operation control in the elevator or lift systems.

For performing the supervisory operation control, it is necessary to detect the generation of vibration (or shaking) in the building in which the elevator system is installed. To this end, it is required to install a seismometer, which is commonly installed in a machine room of the elevator system so as to detect acceleration making appearance on the floor of the machine room. When the sensed acceleration exceeds predetermined reference levels or values listed exemplarily in the following table 1, signals for triggering the supervisory operation are generated.

TABLE 1

| Type of elevator | Reference value set for a single grade or lower one of reference values set for two grades (generation of supervisory operation signal Y) | Higher one of reference values set for two grades (generation of supervisory operation signal R) |
|---|---|---|
| Ordinary elevator | 80 Gal | — |
| Elevator provided with express zone | 80 Gal | 150 Gal |
| Elevator for emergency | 80 Gal | 150 Gal |

As will be seen in the table 1, in the case of the elevator system having an express zone, the seismometer for detecting the vibration of a first intensity grade is operated to generate a supervisory operation signal Y when the seismic acceleration exceeds 80 Gal, while the seismometer set for detecting the vibration of a second intensity grade produces a supervisory operation signal R when the seismic acceleration exceeds 150 Gal, wherein these signals Y and R are transmitted to the elevator control system for putting into effect the supervisory operation.

According to a hitherto known typical supervisory operation, the elevator car is stopped at the nearest landing floor to allow the passengers to get off the car by opening the door and subsequently the car operation is set at rest, when only the seismometer set for the first intensity grade operates to generate the supervisory operation signal Y. On the other hand, when the seismometer set for the second intensity grade also operates to produce the supervisory operation signal R, the car is instantly stopped and the signal R is also transmitted to a supervisor room to inform the supervisor of the emergency stopping of the car. Then, the car is operated at a low speed to the nearest floor if the situation permits, and the passengers are allowed to get off through the opened door. Thereafter, the car operation is stopped with the door being closed, waiting for the arrival of maintenance or service engineers.

According to another example of the hitherto known supervisory elevator operation, upon operation of only the seismometer set for the first intensity grade of vibration and hence generation of only the signal Y, the elevator car is stopped at the nearest landing floor to open the door for allowing the passengers to get off the car, which is followed by the closing of the door. When the earthquake is settled or mitigated after a time lapse and the signal Y produced by the seismometer set for the first grade of seismic intensity disappears, the elevator system is automatically restored to the normal operation. However, in case the seismometer set for the second grade of intensity operates to produce the signal R, emergency stopping of the elevator car takes place as in the case of the first mentioned supervisory control of the prior art. In this connection, it should be mentioned that measures against the seismic vibration should be provided to an adequate extent so that the elevator can be normally operated without failure even under seismic vibration of such a great amplitude which causes the seismometer set for the second grade of intensity to be actuated.

In the case of the earthquake or typhoon of a large size, there is a possibility that a large number of elevator systems should fail in a particular district. For restoring the failed elevators at the earliest convenience, many service engineers must be summoned, which is difficult in actuality. Accordingly, it is desirable to adopt the automatic restoring system such as described in conjunction with the first mentioned supervisory elevator operation of the prior art.

By the way, either in the first or second mentioned supervisory elevator operations of the prior art described above, the supervisory operation signals Y and R produced by the seismometers set for the first and second grades of the seismic intensity should represent appropriately the degree of influence of the earthquake affecting the machines and instruments of the elevator system.

The degree or extent of the influence of earthquake which affects the buildings inclusive of the instruments, machines and other facilities can be estimated on the basis of the steps or grades of seismic intensity stipulated by the Japan Meteorological Agency and summarized in the following table 2 in which the seismic or vibrational accelerations equivalent to the seismic intensity grades as adopted commonly heretofore are also listed in the rightmost column.

TABLE 2

| Grades of Intensity | Description | Equivalent acceleration |
|---|---|---|
| Not felt or intensity 0 | Not felt by person but can be recorded by a seismometer | 0–0.8 Gal |
| Slight or intensity I | Felt by persons at rest or sensitive persons | 0.8–2.5 Gal |
| Weak or intensity II | Felt by many persons. Windows and doors rattle only slightly | 2.5–8.0 Gal |
| Rather strong or intensity III | Buildings swing. Windows and doors rattle appreciably. Hanging objects swing considerably. Surface of liquid in container disturbed. | 8.0–25.0 Gal |
| Strong or intensity IV | Buildings swing intensively. Small objects are displaced or upset. Liquids spilled. Felt outdoors. Many frightened and run outdoors. | 25.0–80.0 Gal |
| Very strong or intensity V | Wall cracked. Gravestones and stone lanterns fallen. Chimneys and masonry damaged. | 80.0–250.0 Gal |
| Disastrous or intensity VI | Less than 30% of buildings destroyed. Landslides and cracks in ground. Difficult to stand. | 250.0–400.0 Gal |
| Very disastrous or intensity VII | More than 30% of buildings destroyed. Landslides, cracks in ground and faults. | Higher than 400.0 Gal |

Heretofore, the supervisory signal Y is generated when the seismic intensity is in the range of, for example, 80 Gal–150 Gal while the signal R is produced when the seismic intensity exceeds 150 Gal, by making reference to the data such as listed in the table 2. However, actual application of the supervisory operation control of this types to elevator systems has encountered some troubles, which will be explained below.

In the following table 3, there are listed vibrations measured in a certain very high building upon occurrence of earthquake of a large size in a distant region.

TABLE 3

| | Underground Room | Machine Room | Ratio |
|---|---|---|---|
| Maximum Acceleration (Half Amplitude) | 2.5 Gal | 15 Gal | 6.0 |
| Maximum Displacement (Half Amplitude) | 55 mm | 130 mm | 2.4 |
| Frequency | 0.1 Hz | 0.2 Hz | 2.0 |

As will be seen from the table 3, the acceleration observed in the underground room is 2.5 Gal, which corresponds to the seismic intensity I in the table 2 when considered in terms of the equivalent acceleration. In contrast, in the machine room standing on the uppermost floor of the building, the acceleration is amplified to 15 Gal which corresponds to the intensity grade III when considered in terms of the equivalent acceleration. The elevator will not be subjected to any damage at the seismic intensity of this grade. In reality, neither the seismometer responded nor the supervisory signal was generated.

However, since the frequency was as low as 0.2 Hz, displacement of great value (e.g. 130 mm in half amplitude) occured, giving rise to considerable swinging or shaking of the building which was accompanied by a great accident that the signal cable communicating the elevator car with the machine room was broken.

In light of the lesson drawn from the happening mentioned above, the level of acceleration at which the supervisory signal is generated was therefore lowered to 30 Gal. Although this value is inadequate because no supervisory signal will be generated in the situation described above, another problem will be encountered if the acceleration level is further lowered.

Later on, upon occurrence of an earthquake of a small size in a near region, vibration listed in the following table 4 was observed in the same building.

TABLE 4

| | Underground Room | Machine Room | Ratio |
|---|---|---|---|
| Maximum Acceleration (Half Amplitude) | 13 Gal | 30 Gal | 2.3 |
| Maximum Displacement (Half Amplitude) | 3 mm | 10 mm | 3.3 |
| Frequency | 1 Hz | 1 Hz | 1 |

In the case of the earthquake under consideration, the acceleration of 13 Gal observed in the underground room was amplified to 30 Gal in the machine room, resulting in that the supervisory signal Y was generated, being accompanied with the stoppage of all the elevator cars at the nearest floors. The elevator cars were at rest about ten minutes after the stoppage.

In this connection, it should be noted that the frequency was 1 Hz and that the displacement was as small as 1 cm in half amplitude, which means that the seismic intensity applied to the building is of such magnitude that the stoppage of the cars is unnecessary. Notwithstanding, the cars were stopped, giving much trouble to the passengers.

As will be understood from the exemplary cases described above, it is doubtful whether there exists a definite relationship between the seismic acceleration and the intensity grade which has been believed to have bearing on the influence affecting the indoor facilities inclusive of the elevator system. This question has heretofore been pointed out in several articles. Among them, the typical one is Takagi's article contained in Meteorological Study Reports, Vol. 20, No. 1, p.p. 78–89 (1969).

FIG. 1 of the accompanying drawings graphically illustrates the actually measured relationship between the seismic intensity grade and the acceleration, in which solid line segments represent the equivalent accelerations listed in the table 2 and the points in black represent the relation between the seismic intensities and the accelerations. As will be seen in FIG. 1, acceleration of 180 Gal is observed at the seismic intensity grade V. Although the acceleration is valid for the equivalent acceleration in the table 2, it has been found that the acceleration of the same magnitude is observed at the intensity grade II. This means that no specific correspondence or relationship exists between the seismic intensity grades and accelerations. Accordingly, an error will be involved if a correspondence is established between the seismic intensity grades and accelerations as indicated in the table 2.

As will now be understood from the above analyses, the hitherto known supervisory operation control system is disadvantageous in that the conditions which allow the entry to the supervisory operation have no bearing on the strong swinging actually felt and possibly bringing about abnormalities in the operations of facilities, thus making it impossible to conduct the supervisory operation under the desired conditions with high reliability and accuracy. The foregoing description has been made particularly in conjunction with the elevator system. However, the description is also relevant in the case of various railway equipments, nuclear power plants, chemical industry plants, facilities for transporting heavy articles and the like. Difficulty has been encountered in carrying out the supervisory operation in conformance with the actual seismic intensity with any reasonable reliability, whenever the situation requires.

An object of the present invention is to provide a supervisory operation control system which is immune to the drawbacks of the prior art described above and capable of performing satisfactorily without fail the supervisory operation of facilities such as an elevator system and the like in conformance with the actually felt swinging or shaking (vibration) of the ground and buildings caused by the earthquake or the like.

In view of the above object, it is proposed according to a general aspect of the invention that when vibration or shaking due to the earthquake or the like occurs in a particular place where facilities such as an elevator system or the like whose operation is to be supervised and installed, a decision as to whether the supervisory operation should be started is not made in dependence on only the magnitude of vibrational acceleration, but the decision is also made in dependence on whether or not a detected product of displacement of the vibration (amplitude value) and speed of the vibration has attained a predetermined value.

The above and other objects, features and advantages of the invention will be apparent from the following detailed description taken in conjunction with the accompanying drawings, in which.

Figure 1:
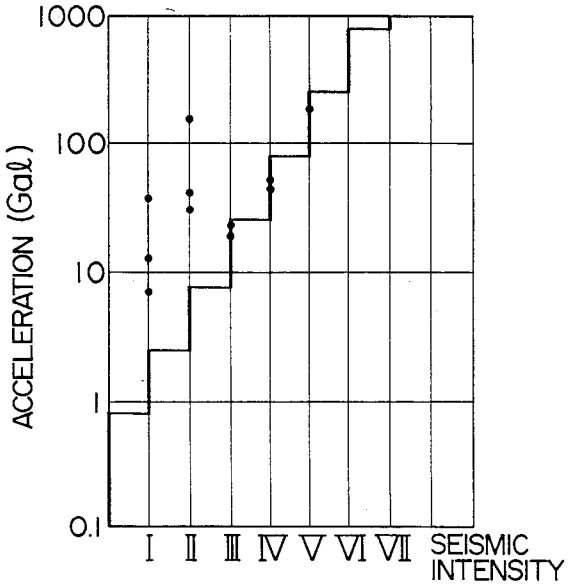
FIG. 1 is a view for graphically showing the relationship between the seismic intensity grade and acceleration together with the actually measured results.
Figure 2:
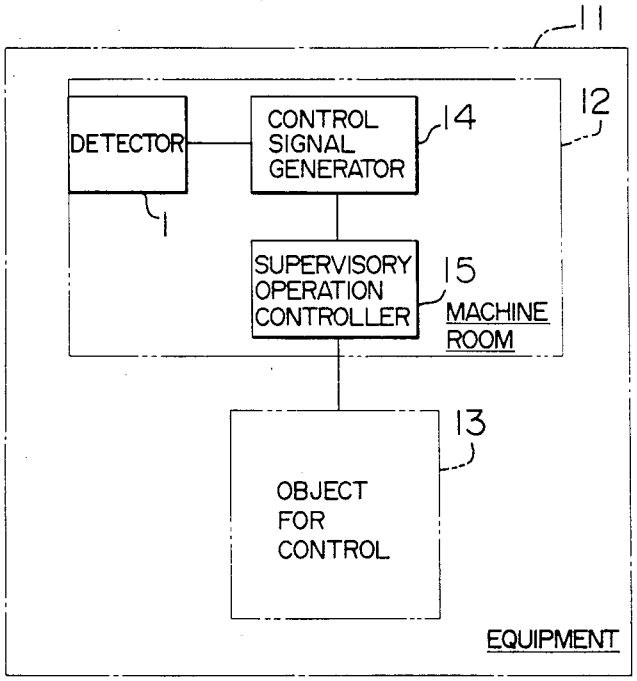
FIG. 2 is a view showing schematically a general arrangement of a system to which the invention is applied.

FIG. 2 is a view showing schematically a general arrangement of an equipment to which the invention is applied. The equipment generally denoted by 11 includes a machine room 12 and an object to be controlled which is driven under the command of the supervisory operation control signal issued from the machine room 12. There are disposed within the machine room 12 an acceleration detector 1 for detecting or sensing vibration of the equipment, a control signal generating device 14 for generating a control signal on the basis of the signal produced by the acceleration detector 1, and a supervisory operation control apparatus 15 for performing the supervisory operation of the object 13 to be controlled in accordance with the control signal produced by the control signal generating device 14. The supervisory operation control apparatus of various types have heretofore been proposed and practically used. The invention can be applied to these known supervisory operation control apparatus without modification. Although the detector 1 is shown as installed in the machine room, it should be understood that the detector may be installed at other locations of the equipment than the machine room.

Figure 3:
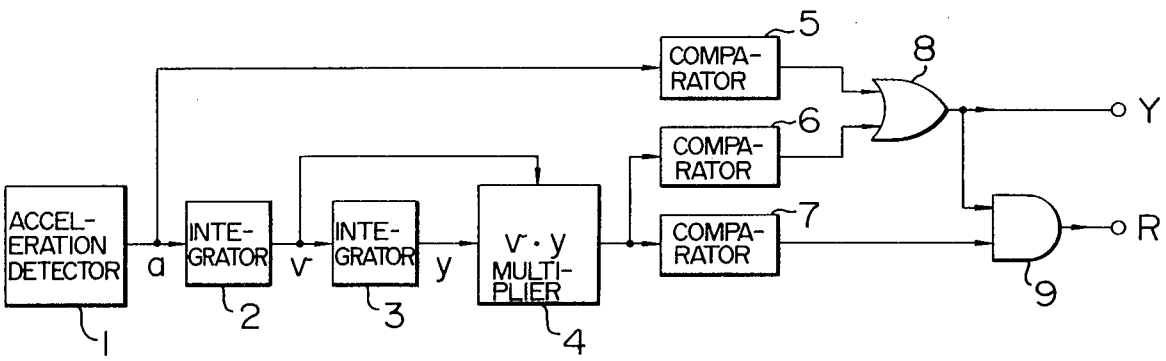
FIG. 3 is a block diagram showing further details of a main portion of the system according to an embodiment of the invention.

FIG. 3 shows in detail an arrangement of the control signal generating device 14 shown in FIG. 2 and constituting a major part of the invention. In FIG. 3, a reference numeral 1 denotes the acceleration detector, 2 denotes an integrator for integrating the acceleration signal a outputted from the detector 1 to thereby produce a speed signal v, 3 denotes an integrator for integrating the speed signal v to derive a displacement signal y, 4 denotes a multiplier for deriving the product v·y of speed and displacement. Comparator 5 compares the acceleration signal a with a predetermined value and provides an output to an OR gate 8. Comparators 6 and 7 compare the product v·y of speed and displacement with predetermined values and provide outputs to the OR gate 8 and AND gate 9, respectively. The output of the OR gate 8 provides the signal Y and is also supplied to the AND gate 9 which provides the signal R.

The following table 5 shows the results of calculation of the product v·y of speed and displacement on the basis of the data contained in the tables 3 and 4. It will be seen that the situation represented by the table 3 corresponds to the seismic intensity grave V with the situation listed in the table 4 corresponding to the seismic intensity grade III with very good approximation to the actual situations.

TABLE 5

| | Acceleration in machine room | Intensity corresponding to acceleration | Maximum value of v · y in machine room | Intensity corresponding to maximum v · y |
|---|---|---|---|---|
| Case of table 3 | 15 Gal | III | 3380 $mm^2/s$ | V |
| Case of table 4 | 30 Gal | II | 100 $mm^2/s$ | III |

It is now assumed that the comparison level of the comparator 5 shown in FIG. 3 is set at 80 Gal, the threshold level of the comparator 6 is set at $1\times10^3$ $mm^2/s$ and that of the comparator 7 is set at $2\times10^3$ $mm^2/S$. On the assumed conditions, no supervisory signal is generated in the case of the situation listed in the table 4 although the supervisory signal R is produced in the case of the earthquake shown in the table 3. In this way, the supervisory operation can be carried out in a rational manner in dependence on the actual seismic intensity. The supervisory operation of the elevator with the aid of these supervisory signals Y and R is carried out in the same manner as in the case of the hitherto known supervisory elevator operations. However, for having a better understanding of the invention, the supervisory operation in which the signals Y and R are made use of will be described below by referring to FIGS. 4, 5 and 6.

Figure 4:
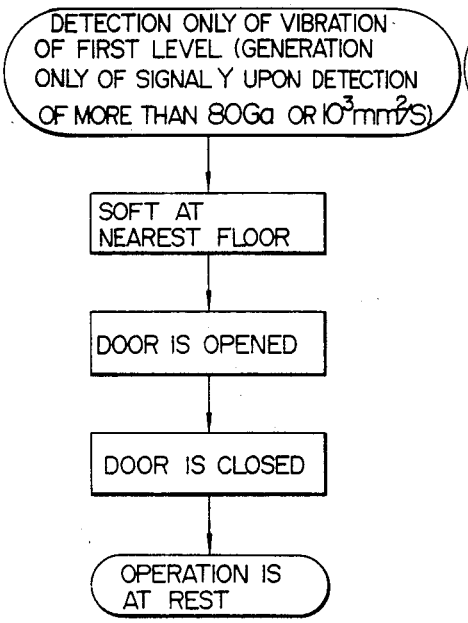
FIGS. 4, 5 and 6 show flow charts for illustrating examples of the supervised operation of an elevator system controlled according to the teachings of the invention.

Referring to FIG. 4, when the control signal generating device 14 produces only the signal Y in response to detection of the vibration of first level set at the comparators 5 and 6, the elevator car is stopped at the nearest floor where the door is opened to allow the passengers to get off. Subsequently, the door is closed and operation of the car is shut down.

Figure 5:
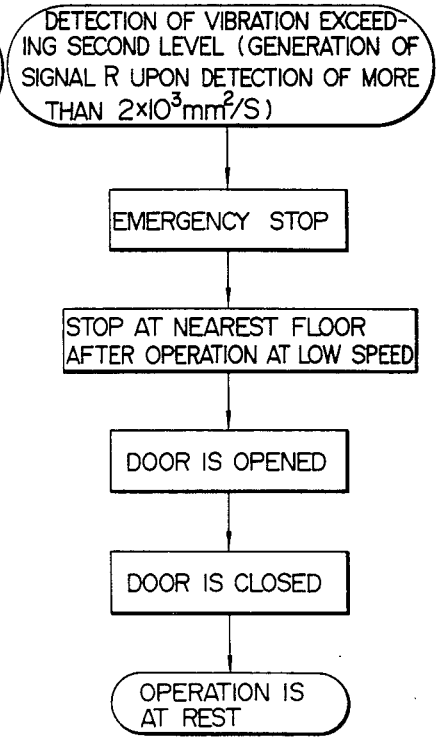

When the vibration of the second level set at the comparator 7 is also detected, the elevator car is instantly stopped (emergency stop), as illustrated in FIG. 5. A signal representative of this situation is transmitted to the supervisor room to inform the supervisor of the emergency stopping of the car, whereupon the supervisor causes the elevator car to run to the nearest landing floor at a low speed, if the situation allows it. By opening the door, the passenger can get off the car. Thereafter, the door is closed and arrival of service engineers is awaited.

Figure 6:
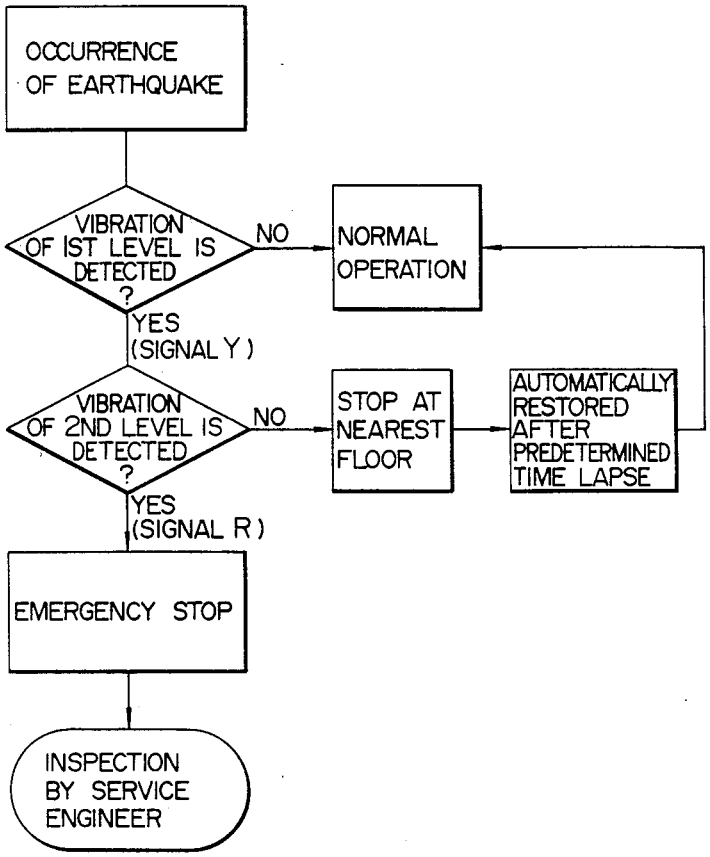

FIG. 6 illustrates another example of the supervisory operation according to another embodiment of the present invention. Referring to the figure, upon detection only of the vibration of the first level, i.e. upon generation only of the signal Y, the car is caused to stop at the nearest floor to allow the passengers to get off by opening the door. The car is subsequently at rest with the door being closed. When the earthquake is settled after a time lapse, being accompanied with disappearance of the signal Y, the ordinary car operation is automatically restored. However, when the signal R is generated in response to detection of the vibration of the second level, the elevator car is instantly stopped as in the case illustrated in FIG. 5.

Figure 7:
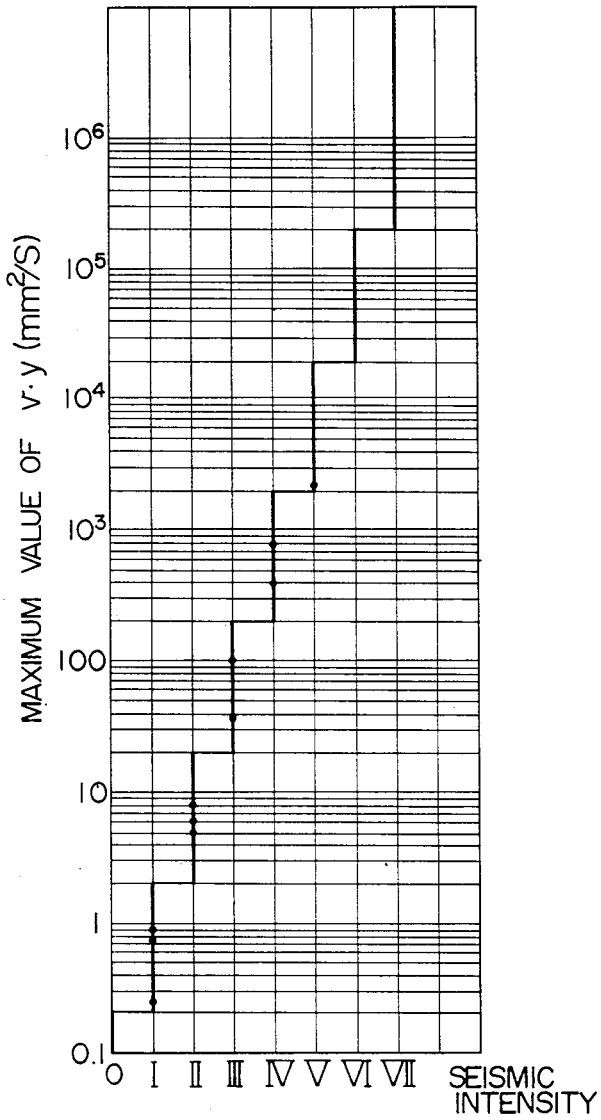
FIG. 7 is a view for graphically illustrating the relation between maximum value of product of speed and displacement of the seismic and the seismic intensity grade together with actually measured values.

FIG. 7 graphically illustrates the relationship existing between the product v·y ($mm^2/S$) of the displacement (amplitude) y (mm) and the speed v (mm/S) of seismic vibration and the seismic intensity grade together with the calculated values based on the measured values shown in black spots. As will be clearly seen in FIG. 7, the product v·y of displacement and speed exhibits very proper correlation with the seismic intensity grade.

Next, theoretical ground for the existence of the favorable correlation mentioned above will be explained below.

Figure 8:
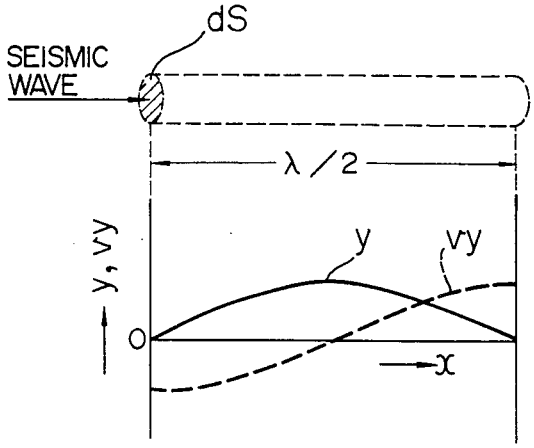
FIG. 8 is a schematic diagram for illustrating the concept of the invention.

Referring to FIG. 8, it is assumed that the seismic wave of wavelength λ and period T reaches at a minute area dS. The phase after lapse of time T/2 from the arrival of the seismic wave advances by λ/2 from the area dS.

The seismic waves comprise a longitudinal compressional or primary or P wave and a transverse, shear or secondary or S wave. In terms of energy, it is sufficient to consider only the S wave.

Since the S wave is a transverse wave, displacement y brought about by the seismic motion is produced in the direction perpendicular to the propagating direction of the seismic wave.

Time differential of displacement y given by $$V=dy/dt \tag{1}$$

represents the vibrational speed or rate of the seismic motion whose distribution is such as indicated by a broken line in FIG. 8.

Considering a point at which the distance from dS is in the range of 0 to λ/2, kinetic energy $E_v$ and strain energy $E_s$ per unit volume of medium at that point are, respectively, given by the following expressions. Namely, $$E_v=\tfrac{1}{2}\cdot\rho\cdot(dy/dt)^2 \tag{2}$$

where ρ represents density ($g/cm^3$) of the medium, and $$E_s=\tfrac{1}{2}\cdot\mu\cdot(dy/dt)^2 \tag{3}$$

where μ represents shear modulus of the medium.

When the whole volume dS·(λ/2) is considered, the total sum of the kinetic energy is equal to the total sum of the strain energy.

The total sum $W_v$ of kinetic energy is given by $$W_v = \tfrac{1}{2}\cdot dS\cdot\frac{\lambda}{2}\cdot\rho\cdot\frac{1}{(T/2)}\cdot\int_0^{\frac{T}{2}}\left(\frac{dy}{dt}\right)^2 dt = \tfrac{1}{2}\cdot\rho\cdot dS\cdot V_s\cdot\int_0^{\frac{T}{2}}\left(\frac{dy}{dt}\right)^2 dt \tag{4}$$

where $V_s$ represents the propagating speed of the S wave which is given by $$V_s=\lambda/T \tag{5}$$

On the other hand, the total sum $W_s$ of the strain energy is given by $$W_s = \tfrac{1}{2}\cdot dS\cdot\frac{\lambda}{2}\cdot\mu\cdot\frac{1}{(T/2)}\cdot\int_0^{\frac{1}{2}}\left(\frac{dy}{dt}\right)^2 dt = \tfrac{1}{2}\cdot\mu\cdot dS\cdot V_s\cdot\int_0^{\frac{1}{2}}\frac{(dy/dt)^2}{(dx/dt)^2}\,dt \tag{6}$$

-continued $$= \tfrac{1}{2} \cdot \mu \cdot dS \cdot \frac{1}{Vs} \cdot \int_0^{\frac{T}{2}} \left(\frac{dy}{dt}\right)^2 dt$$

$$= \tfrac{1}{2} \cdot \rho \cdot dS \cdot V_s \cdot \int_0^{\frac{T}{2}} \left(\frac{dy}{dt}\right)^2 dt$$

$$= W_v$$

In the development of the above expression, the following relation is made use of:

$$V_s = dx/dt = \sqrt{\mu/p} \tag{7}$$

Since the whole energy W of the volume dS ($\lambda/2$) is the sum of $W_v$ and $W_s$, $$W = W_v + W_s = \rho \cdot dS \cdot Vs \cdot \int_0^{\frac{T}{2}} \left(\frac{dy}{dt}\right)^2 dt \tag{8}$$

Now assuming that displacement y of the seismic motion is vibrating in accordance with $$y = D \cdot \sin 2\pi ft \tag{9}$$

where f represents the frequency (Hz) given by $$f = 1/T \tag{10}$$

then $$V = dy/dt = 2\pi f \cdot D \cdot \cos 2\pi ft \tag{11}$$

Accordingly, the expression (8) can be rewritten as follows:

$$W = \pi^2 \cdot \rho \cdot dS \cdot V_s (D^2/T) = K \cdot dS \cdot (D^2 T) \tag{12}$$

where $$K = \pi^2 \cdot \rho \cdot V_s = \pi^2 \sqrt{\rho \cdot \mu} \tag{13}$$

Since $\rho$ and $\mu$ are essentially constant, K may be regarded to be constant.

Accordingly, the wave energy can be determined if the amplitude and period of the vibrational displacement of the point in concern are known, as is pointed out by Takagi in his article cited hereinbefore.

Although the above relation is convenient for determining the wave energy from the oscillogram of the displacement of seismic motion, it is difficult to realize the detector for sensing the wave energy on the real-time basis by making use of the above relation, because the period of the seismic wave is as long as 5 to 10 sec. If the measure against the earthquake is taken by calculating the wave energy after the lapse of the period of such long duration, adequate protection can not be afforded for preventing accidents from occurring because activation of the protecting measures is too late in time. Besides, since the seismic wave is of much complicated waveform, great difficulty will be encountered in determining the period and amplitude (displacement) of the seismic motion. Thus, it becomes difficult to take the measures most proper to the seismic motion. Furthermore, the calculator capable of executing arithmetic operations including division such as the term $D^2/T$ of the expression (12) is relatively expensive, to another disadvantage.

Such being the circumstances, the inventors have proceeded with examination as follows.

When the product of the vibrational displacement y and the vibrational speed v of the seismic motion is represented by $e_t$, the latter can be arithmetically determined as follows:

$$\begin{aligned} e_t &= y \cdot v \\ &= D \cdot \sin 2\pi ft \cdot 2\pi f D \cdot \cos 2\pi ft \\ &= \pi \cdot f \cdot D^2 \cdot \sin 4\pi ft \\ &= \pi \cdot (D^2/T) \sin 4\pi ft \\ &= e \cdot \sin 4\pi ft \end{aligned} \tag{14}$$

where e represents the amplitude of $e_t$ which is given by $$e = \pi \cdot (D^2/T) = (\pi/K \cdot dS) W \tag{15}$$

Referring also to the expression (12), it will be seen that the amplitude e of $e_t$ is in proportional relation to the wave energy. Accordingly, the wave energy can be determined if e or $e_t$ is known.

The product $e_t$ of the vibrational displacement y and the vibrational speed v can be determined with the aid of the circuit arrangement shown in FIG. 3 as the value changing from time to time on the real-time basis. The sensor serving to this end can be implemented in a relatively simplified structure because no dividing operation is included.

Since the direction of the seismic wave is not constant, it is necessary to detect the wave energy of the seismic wave in a given direction. The apparatus for detecting the wave energy will be described by referring to FIG. 9.

Figure 9:
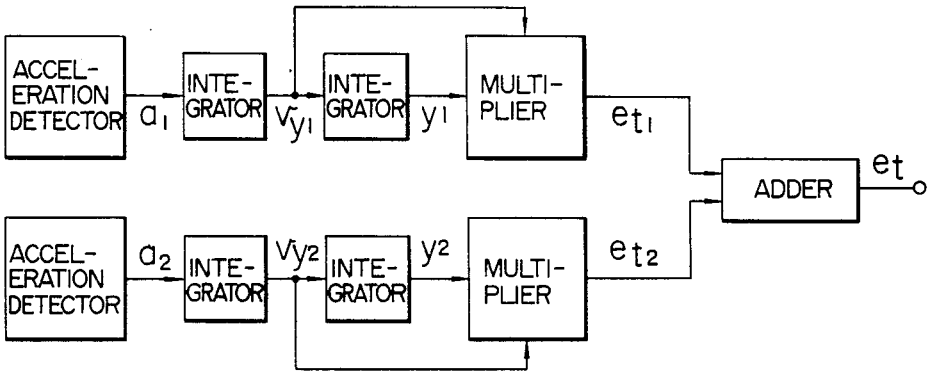
FIG. 9 is a block diagram showing a main portion of the system according to another embodiment of the invention.

It is now assumed that the seismic wave is propagating in a horizontal plane. Referring to FIG. 9, a pair of acceleration sensors are disposed on the plane in directions $y_1$ and $y_2$, respectively, which are orthogonal to each other, to thereby obtain the amplitudes $D_1$ and $D_2$, respectively, of the vibrational displacement. Then, the wave $W_1$ in the direction $y_1$ is given by $$W_1 = K \cdot dS (D_1^2/T) \tag{16}$$

The wave energy in the direction $y_2$ is given by $$W_2 = K \cdot dS (D_2^2/T) \tag{17}$$

When the sum of $W_1$ and $W_2$ is represented by W, then $$\begin{aligned} W &= W_1 + W_2 \\ &= K \cdot dS \cdot \left(\frac{D_1^2}{T} + \frac{D_2^2}{T}\right) \\ &= K \cdot dS \cdot (D^2/T) \end{aligned} \tag{18}$$

where D is given by $$D^2 = D_1^2 + D_2^2 \tag{19}$$

and represents the amplitude of the vibrational displacement of the seismic wave propagating along the given direction in the horizontal plane. The wave energy thereof is represented by W.

In FIG. 9, symbols $a_1$ and $a_2$ represent the vibrational accelerations in the directions $y_1$ and $y_2$, respectively. Similarly to the case of the embodiment shown in FIG. 3, the vibrational speed $V_{y1}$ and the vibrational displacement $y_1$ in the direction $y_1$ are determined and multiplied with each other, the result of which is represented by $e_{t1}$. Then, $$e_{t1} = V_{y1} \cdot y_1 \quad (20)$$
$$= \pi(D_1^2/T)\sin 4\pi ft$$

Similarly, product of the vibrational speed $V_{y2}$ and the vibrational displacement $y_2$ in the direction $y_2$ is determined and represented by $e_{t2}$. Then, $$e_{t2} = V_{y2} \cdot y_2 \quad (21)$$
$$= \pi(D_2^2/T)\sin 4\pi ft$$

When the sum of $e_{t1}$ and $e_{t2}$ is represented by $e_t$, $$e_t = e_{t1} + e_{t2} \quad (22)$$
$$= \pi\left(\frac{D_1^2}{T} + \frac{D_2^2}{T}\right) \sin 4\pi ft$$
$$= \pi \cdot (D^2/T) \cdot \sin 4\pi ft$$
$$= e \sin 4\pi ft$$

where e represents the amplitude of $e_t$ and is given by $$e = \pi(D^2/T) = (\pi/K \cdot dS) \cdot W \quad (23)$$

It will be seen that the amplitude e of $e_t$ is in proportional relation to the seismic wave energy W in the given direction. This amplitude e is compared with the preset value through the comparator, as in the case of the embodiment shown in FIG. 3.

As will now be understood from the foregoing theoretical analyses, the product v·y of the speed and displacement of the seismic wave is a quantity which is in proportion to the seismic wave energy passing the location where the acceleration detector is installed. For this reason, it is believed that the product v·y is in close correlation with the seismic intensity grade, as illustrated in FIG. 7.

In the embodiment shown in FIG. 3, the comparator 5 and the logical OR element 8 are employed to generate the supervisory signal Y when the acceleration a exceeds a preset value, e.g. 80 Gal. This arrangement serves for producing instantly the supervisory signal upon sudden generation of great acceleration as in the case of earthquake whose source lies directly under the region in concern and additionally serves for backing-up purpose in case the integrator and the multiplier should fail.

In the foregoing description, the invention is assumed to be applied to the supervisory operation of the elevator system. It goes, however, without saying that the invention is never restricted to the application to the elevator system. In the case of other facilities than the elevator system, the supervisory signal derived according to the teachings of the invention can be utilized for the supervisory operations of such facilities in various manners known per se.

As will now be appreciated, the condition under which the supervisory operation of the elevator system or the like is put into effect can be made to conform with the swinging or shaking actually felt according to the invention. By virtue of this feature, the supervisory operation can be carried out in a rational manner with an improved reliability upon generation of vibration or shaking of the building or the like due to high wind and earthquake without being subjected to the shortcomings of the prior art techniques, whereby the supervisory operation control system which can assure well balanced high security with the practical applications is realized.

We claim:

1. A supervisory operation control system including vibration detecting means for detecting vibration occurring at a predetermined location of an equipment, control signal generating means for generating a control signal when a value relating to said vibration and derived from the detection signal produced by said detecting means exceeds at least one predetermined value and supervisory operation controlling means for controlling the supervisory operation of said equipment in dependence on said control signal produced by said control signal generating means, wherein said control signal generating means comprises:
   - speed/displacement detecting means for determining the speed and displacement of said vibration on the basis of said detection signal;
   - multiplying means for determining a product of said speed and displacement obtained through said speed/displacement detecting means; and
   - comparing means for generating the control signal when the value of said product determined by said multiplying means exceeds said predetermined value.

2. A supervisory operation control system according to claim 1, wherein said vibration detecting means is constituted by an acceleration detector.

3. A supervisory operation control system according to claim 2, wherein said speed/displacement detecting means is composed of a first integrating stage for determining the speed by integrating the detection signal produced by said acceleration detector and a second integrating stage for integrating the speed determined by said first integrating stage to thereby determine the displacement.

4. A supervisory operation control system according to claim 2, wherein said comparing means further includes comparison means for generating the control signal when the detection signal outputted from said acceleration detector exceeds the predetermined value.

5. A supervisory operation control system according to claim 1, wherein said comparing means includes first comparison means for generating a first control signal when the value of said product exceeds a first predetermined value, and a second comparison means for generating a second control signal when the value of said product exceeds a second predetermined value which is greater than said first predetermined value, said supervisory operation control means performing operations which differ from each other in dependence on whether only said first control signal is received or said second control signal is received.

6. A supervisory operation control system according to claim 1, wherein said vibration detecting means is composed of at least two vibration detectors for detecting vibrations of mutually different directions;

said control signal generating means including speed/displacement detecting means for determining said speed and displacement on the basis of the detection signals produced by said vibration detectors and multiplying means for determining a product of said speed and displacement, and adding means for adding values of said products;

said comparing means comparing the added values produced from said adding means with said predetermined value.

* * * * *